US011702891B2

(12) United States Patent
Zhao et al.

(10) Patent No.: US 11,702,891 B2
(45) Date of Patent: Jul. 18, 2023

(54) FORCE MODULATION SYSTEM WITH AN ELASTIC FORCE MEMBER FOR DOWNHOLE CONDITIONS

(71) Applicants: CNPC USA Corporation, Houston, TX (US); Beijing Huamei Inc. CNPC, Beijing (CN)

(72) Inventors: Lei Zhao, Houston, TX (US); Ming Zhang, Houston, TX (US); Chris Cheng, Houston, TX (US); Jiaxiang Ren, Houston, TX (US); Chengxi Li, Houston, TX (US)

(73) Assignees: CNPC USA Corporation, Houston, TX (US); Beijing Huamei Inc. CNPC, Beijing (CN)

( * ) Notice: Subject to any disclaimer, the term of this patent is extended or adjusted under 35 U.S.C. 154(b) by 38 days.

(21) Appl. No.: 17/378,942

(22) Filed: Jul. 19, 2021

(65) Prior Publication Data

US 2022/0162915 A1 May 26, 2022

Related U.S. Application Data

(63) Continuation-in-part of application No. 17/100,870, filed on Nov. 21, 2020, now Pat. No. 11,499,377, and (Continued)

(51) Int. Cl.

| | |
|---|---|
| ***E21B 10/62*** | (2006.01) |
| ***E21B 10/55*** | (2006.01) |
| ***E21B 10/42*** | (2006.01) |

(52) U.S. Cl.

CPC ..... *E21B 10/62* (2013.01); *E21B 10/42* (2013.01); *E21B 10/55* (2013.01)

(58) Field of Classification Search

CPC ..... E21B 10/62; E21B 12/00; E21B 10/42; E21B 10/00; E21B 10/325; E21B 10/32; D02G 1/02

See application file for complete search history.

(56) References Cited

U.S. PATENT DOCUMENTS

| | | | |
|---|---|---|---|
| 2,462,316 | A | 2/1949 | Goodloe |
| 2,869,858 | A | 1/1959 | Hartwell |

(Continued)

FOREIGN PATENT DOCUMENTS

| | | | |
|---|---|---|---|
| CN | 110273650 | A | 9/2019 |
| RU | 2545142 | C1 | 3/2015 |

*Primary Examiner* — Caroline N Butcher

(74) *Attorney, Agent, or Firm* — Craft Chu PLLC; Andrew W. Chu

(57) ABSTRACT

The force modulation system for a drill bit includes a cutter, a holder, a holder retention device, and a first force member made of a first woven material. The cutter fits in the holder, and the holder fits in the drill bit. The holder retention device exerts a holder retention force in a first direction. The first force member exerts a first force in a second direction. The second direction is angled offset to the first direction so as that a cutting profile of the force modulation system is variable. There can also be a second force member of a second woven material to exert a second force in the first direction for more variability of the cutting profile in the first direction. The second force member can be made integral with the first force member, including the first woven material and the second woven material being the same material.

16 Claims, 5 Drawing Sheets

Related U.S. Application Data a continuation-in-part of application No. 17/100,872, filed on Nov. 21, 2020, now Pat. No. 11,499,378.

(56) References Cited

U.S. PATENT DOCUMENTS

| | | | | |
|---|---|---|---|---|
| 3,073,557 | A | 1/1963 | Davis | |
| 4,514,458 | A * | 4/1985 | Thorn | F16F 1/362 428/605 |
| 5,230,407 | A | 7/1993 | Smith et al. | |
| 9,239,121 | B1 * | 1/2016 | Ragner | B32B 3/28 |
| 2010/0212964 | A1 * | 8/2010 | Beuershausen | E21B 7/064 175/57 |
| 2018/0030786 | A1 * | 2/2018 | Dunbar | E21B 10/42 |
| 2019/0100968 | A1 | 4/2019 | Spencer | |

* cited by examiner

FORCE MODULATION SYSTEM WITH AN ELASTIC FORCE MEMBER FOR DOWNHOLE CONDITIONS

CROSS-REFERENCE TO RELATED APPLICATIONS

The present application claims priority under 35 U.S.C. Section 120 from U.S. patent application Ser. No. 17/100,870, filed on 21 Nov. 2020, entitled "FORCE MODULATION SYSTEM FOR A DRILL BIT".

The present application claims priority under 35 U.S.C. Section 120 from U.S. patent application Ser. No. 17/100,872, filed on 21 Nov. 2020, entitled "BLADE CAP FORCE MODULATION SYSTEM FOR A DRILL BIT".

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to cutting elements on a drill bit. More particularly, the present invention relates to a force modulation system for fixed cutters on the drill bit. Even more particularly, the present invention relates to a force modulation system with an elastic force member for downhole conditions.

2. Description of Related Art Including Information Disclosed Under 37 CFR 1.97 and 37 CFR 1.98

Polycrystalline diamond compact (PDC) cutters are used in drilling operations for oil and gas. Prior art drill bits include roller cone bits with multiple parts and rotating cutters to gouge and scrape through the rock formation. Rows of cutters moved along parts of the drill bit so that wear on the cutters was distributed. The multiple parts of the drill bit include the bit blade, bit body, cone, bearing and seal. Newer drill bits were fixed-head drill bits, which were composed of a single drill bit without any moving components. The cutters were fixed on either the bit blade or bit body of the drill bit. The fixed-head drill bits are rotated by the drill string, so moving parts on the drill bit were not needed. The cutters fixed to the parts of the drill bit determine the cutting profile for a drill bit and shear through the rock formation in place on the drill bit. The fixed cutters were more reliable under extreme heat and pressure conditions of the wellbore because there were no moving components. However, the wear on these cutters was substantial.

The further complication is that the wear on fixed cutters is not equal. There are regular sources of damage to all fixed cutters, like vibration and impact load. However, fixed cutters on different parts of the drill bit wear at different rates. For example, the fixed cutters in the cone do not wear at the same rate and manner as fixed cutters on the bit blade. In particular, the fixed cutters placed on the bit blade are on a side of the drill bit and have the highest linear cutting velocity that results in more severe wear and the most cutting force. The damage to all fixed cutters and the extra damage to fixed cutters on the bit blade cause premature failure of the drill bit, limit rate of penetration into the rock formation, and limit the footage drilled into the rock formation.

The prior art already discloses adjustments to the cutting profile of fixed cutters while drilling. FIG. 1 shows the prior art system with a fixed cutter 1 mounted in a holder 2. The holder 2 is mounted in the drill bit 3. There is a retention member 4 to hold the cutter 1 within the holder 2, and there is an elastic member 5 between the holder 2 and the drill bit 3. The elastic member 5 can be a spring, which compresses to lessen the cutting force against harder rock. The lesser force on the fixed cutter can prevent damage. The spring sets the upper limit of cutting force. Any higher load will cause the fixed cutter to retract. Various patents and publication disclose this mechanism of a spring that reduces the force on the fixed cutter, including CN 105604491, published on 2016 May 25 for Li, CN 204326973, published on 2015 May 13 for Ge, Huixiang et al., CN 105156035, published on 2017 Mar. 29 for Hua, Jian et al., USPub 20100212964, published on 2010 Aug. 26 for Beuershausen, U.S. Pat. No. 10,000,977, issued on 2018 Jun. 19 for Jain et al, U.S. Pat. No. 6,142,250, issued on 2000 Nov. 7 for Griffin et al., and U.S. Pat. No. 5,678,645, issued on 1997 Oct. 21 to Tibbitts et al. Being a fixed cutter on refers to being fixed in position on the drill bit. The fixed cutter is not completely locked in position. The fixed cutter is not perfectly fixed in place. The fixed cutter moves toward and away from the drill bit in the one direction of the elastic member.

There have been slight modifications to the prior art system, such as the cutter with retention member directly in the drill bit without a holder. See Zongtao et al., CN 104564064, published on 2015 Apr. 29 for Liu, Zhihai et al. Different elastic members are also known in U.S. Pat. No. 10,494,876, issued on 2019 Dec. 3 to Mayer et al., U.S. Pat. No. 9,938,814, issued on 2018 Apr. 10 to Hay, U.S. Pat. No. 10,759,092, issued on 2020 Sep. 1 to Yu et al, and CN 108474238, published on 2018 Aug. 31 for Grosz, Gregory Christopher. The prior art systems remain unidirectional. The variation in force on the fixed cutter is limited to the orientation of the elastic member. The cutting profile can change only slightly as individual fixed cutters can move up and down in the one direction of the elastic member. The one dimensional variations to the cutting profile fail to effectively protect fixed cutters on the parts of the drill bit that encounter angled forces with drilling. In particular, the fixed cutters on the bit blade or shoulder of the drill bit, known as shoulder cutters, encounter the junctions between different rock formations and require the most cutting force. There are forces against the fixed cutter by the rock formations in more than one dimension at these junctions.

The elastic members currently known for downhole tools include the springs of CN 105604491, published on 2016 May 25 for Li, CN 204326973, published on 2015 May 13 for Ge, Huixiang et al., CN 105156035, published on 2017 Mar. 29 for Hua, Jian et al., USPub 20100212964, published on 2010 Aug. 26 for Beuershausen, U.S. Pat. No. 10,000,977, issued on 2018 Jun. 19 for Jain et al, U.S. Pat. No. 6,142,250, issued on 2000 Nov. 7 for Griffin et al., and U.S. Pat. No. 5,678,645, issued on 1997 Oct. 21 to Tibbitts et al. Elastic members for force modulation can also be an elastomeric insert, a plastic insert, metal mesh, disc spring, composite elastomeric insert, or hydraulic actuator, in addition to a metal coil spring. Wire mesh as a damper in a downhole tool is also known in prior art patents, including U.S. Pat. No. 2,462,316, issued on 22 Feb. 1949 to Goodloe, U.S. Pat. No. 2,869,858, issued on 20 Jan. 1959 to Hartwell, U.S. Pat. No. 3,073,557, issued on 15 Jan. 1963 to Davis, Russian Patent No. RU2545142, issued on 27 Mar. 2015 to Alekseevich, U.S. Pat. No. 4,514,458, issued on 30 Apr. 1985 to Thorn et al, U.S. Pat. No. 5,230,407, issued on 27 Jul. 1993 to Smith et al, US Publication No. 2019/0100968, published on 4 Apr. 2019 for Spencer, and Chinese Patent No. CN110273650, issued on 24 Sep. 2019 to Chengdu Weiyi Petroleum Co.

However, the downhole conditions and space restraints of a drill bit are not compatible with all types of elastic members to exert force on a cutter. There is a need for a specialized force member that addresses the specific problems of the elevated temperatures and pressures of downhole conditions. Without a reliable and durable force member, a force modulation system will fail too quickly.

It is an object of the present invention to provide a force modulation system with a variable cutting profile of a drill bit.

It is an object of the present invention to provide a multi-directional force modulation system.

It is another object of the present invention to provide a force modulation system with an elastic member for downhole conditions.

It is another object of the present invention to provide a force modulation system with a wire woven elastic member as a force member to fit in the limited space of a drill bit and withstand downhole conditions.

These and other objectives and advantages of the present invention will become apparent from a reading of the attached specification, drawings and claims.

BRIEF SUMMARY OF THE INVENTION

Embodiments of the force modulation system for a drill bit include a cutter, a holder, a holder retention means, and a first force member comprised of a first woven material. The cutter is in removable slide fit engagement with the holder. The cutter extends from the holder so as to drill into rock formations. The holder retention means sets the position of the holder within the drill bit. The cutter fits in the holder, and the holder fits in the drill bit. The holder retention means exerts a holder retention force in a first direction of the holder. The holder retention force maintains the position relative to the drill bit. In particular, the first direction is one direction of movement of the holder relative to the drill bit, and the holder retention means exerts the holder retention force in that first direction so as to prevent movement of the holder in that first direction. The first force member is positioned against the holder so as to exert a first force in a second direction of the holder. The first force also maintains the position of the holder relative to the drill bit, but in a different dimension. In particular, the second direction is another direction of movement of the holder relative to the drill bit. The second direction is angled offset to the first direction. The second direction can be orthogonal to the first direction. Relative to the holder cavity, the first direction can be vertical, and the second direction can be horizontal. The holder retention means and the first force member are cooperative to maintain position of the holder in more than one dimension, i.e. in more than the first direction.

The first force in the second direction determines the cutting profile of the force modulation system. The first force member exerts a first force that is variable so that the cutter avoids damage from excessive force in the second direction. The second direction of the first force member is not the same as the first direction. The second direction is offset angled so that excessive force of a different direction than the first direction can be avoided. The force modulation system can avoid damage from excessive force from different directions.

An alternate embodiment of the force modulation system includes a second force member positioned against the holder so as to exert a second force in the first direction of the holder. The second force member is an additional support against excessive force in the first direction and is comprised of a second wire woven material. The holder retention member can be set as a breaking point before the critical amount of excessive force that causes damage to the cutter. To protect the holder retention means from being disabled from excessive force, the second force member provides the second force in the first direction as a supplement to the holder retention force in the first direction. The cutting profile of the force modulation is now determined by both the first force in the second direction and the second force in the first direction. The cutter can now avoid the damage of excessive force in the first direction AND in the second direction.

Embodiments of the present invention include the first force member being comprised of a first wire woven material with a first elasticity. The first wire woven material can be comprised of a braided and compression molded spring wire that withstands downhole conditions. The first wire woven material can fit between the holder and drill bit and within the space constraints for a downhole tool. Some embodiments include a corrosion resistant coating on the spring wire to further increase durability of the first wire woven material. In embodiments of the force modulation system with the second force member, the first force member can be made integral with the second force member such that the first woven material is compatible with and bonded to the second woven material. In some embodiments, the first woven material is the same as the second woven material as a unitary force member of woven material. The method of forming the first wire woven material is also an embodiment of the present invention.

DETAILED DESCRIPTION OF THE INVENTION

Figure 1:
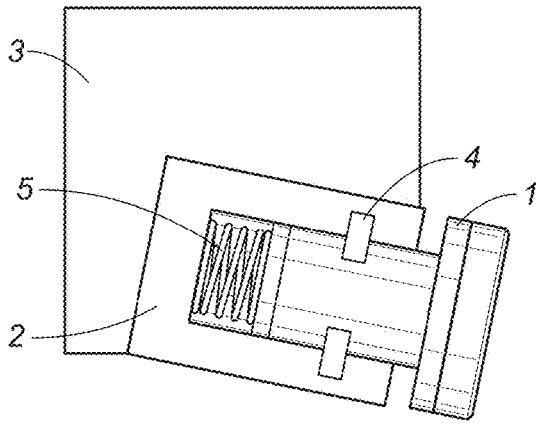
FIG. 1 Prior Art
FIG. 1 is a schematic sectional view of a prior art force modulation system.

Conventional force modulation systems are limited to one dimension and one direction. The cutter, or the cutter in a holder, moves up and down within a drill bit cavity formed to fit the cutter or holder. A spring sits at the bottom of the drill bit cavity. The spring is compressible so as to reduce the amount of force exerted on the cutter by the rock formation. The cutter maintains position within the drill bit cavity to withstand sufficient force to drill through rock, while avoiding excessive force that would damage the cutter. The in and out of the drill bit cavity direction is one dimensional, corresponding to excessive force from depth of cut of the drill bit. These force modulation systems cannot account for offset force vectors, such as those forces created on the shoulder cutters or cutters on the bit blade of the drill bit at junctions between different types of rock materials in a rock formation. There can be excessive force from impact forces of the rock materials that would damage the cutter from a different direction than the one direction set by force modulation systems of the prior art. The elastic members, like springs, for these force modulation systems lack durability in downhole conditions, like temperature and pressure. The elastic members for these force modulation systems must also fit in the limited space constraints between the holder and the drill bit.

Referring to FIGS. 2-13, the force modulation system 10 for a drill bit includes a cutter 20, a holder 30, a holder retention means 50, and a first force member 60. The cutter 20 is comprised of a cutter body 22 having a cutting end 24, and a cutting surface 26 made integral with the cutter body 22 at the cutting end 24. The holder 30 is comprised of a holder body 32 having an anchor end 34, a holding end 36 opposite the anchor end 34, holder sides 38 between the anchor end 34 and the holding end 36, and a holder cavity 40 at the holding end 36. The cutter body 22 is in slide fit engagement with the holder cavity 40. The cutting surface 26 extends from the holder cavity 40 so as to drill into rock formations. The cutter 20 is removably engaged with the holder 30.

Figure 2:
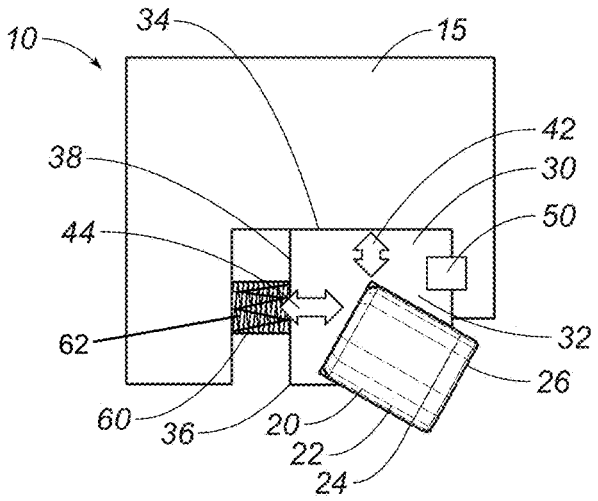
FIG. 2 is a schematic sectional view of an embodiment of the force modulation system according to an embodiment of the present invention.
Figure 3:
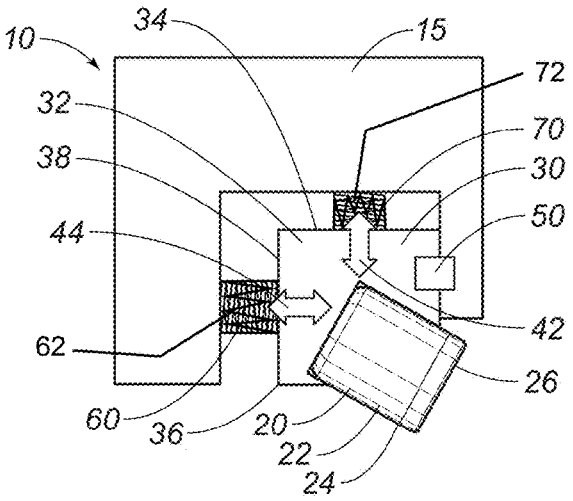
FIG. 3 is a schematic sectional view of an embodiment of the force modulation system according to another embodiment of the present invention.

The force modulation system 10 includes the holder retention means 50 positioned on at least one holder side 38 so as to exert a holder retention force in a first direction 42 of the holder 30. FIGS. 2 and 3 show the first direction 42 as one direction of movement of the holder 30 relative to the drill bit. The holder retention means 50 can be a snap ring as in FIGS. 2-3, shear pin as in FIGS. 2-3, locking ring, locking pin, slot shoulder as in FIG. 4, screw as in FIGS. 5-8 or other known mechanical device to hold position of the holder 30.

Figure 9:
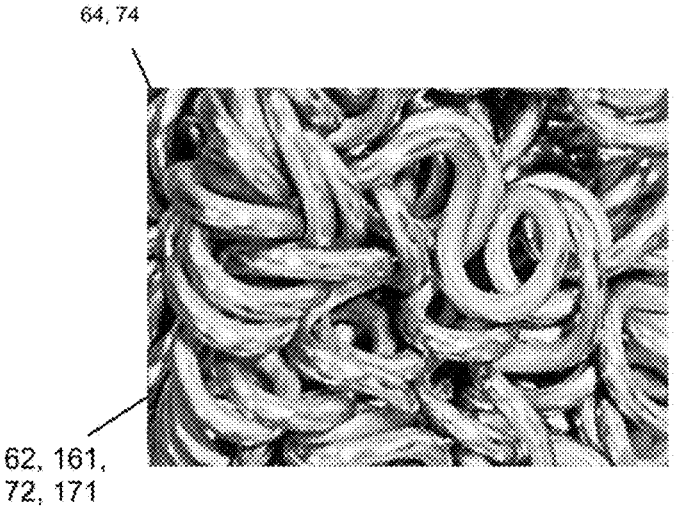
FIG. 9 is a photographic illustration of a wire woven material according to an embodiment of the present invention.
Figure 10:
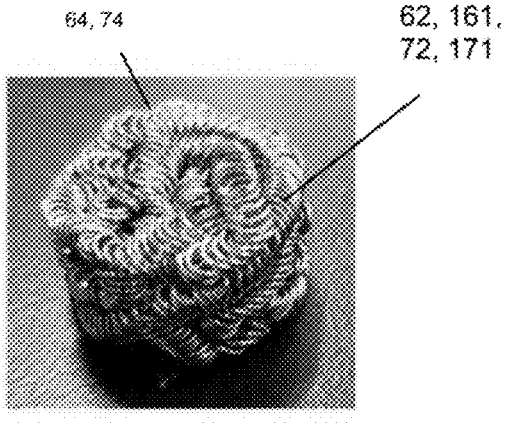
FIG. 10 is a photographic illustration of a wire woven material according to an embodiment of the present invention.
Figure 11:
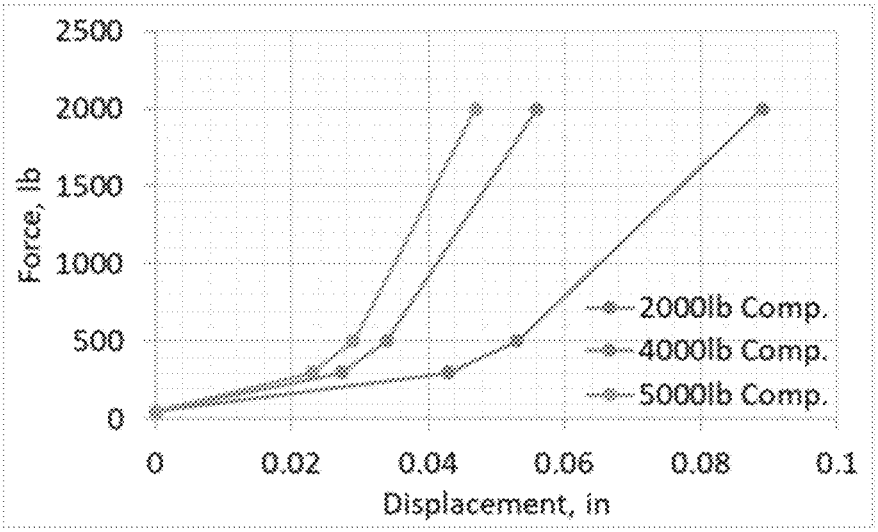
FIG. 11 is a graph illustration of stress-strain curves of wire woven materials at different compressive loading.
Figure 12:
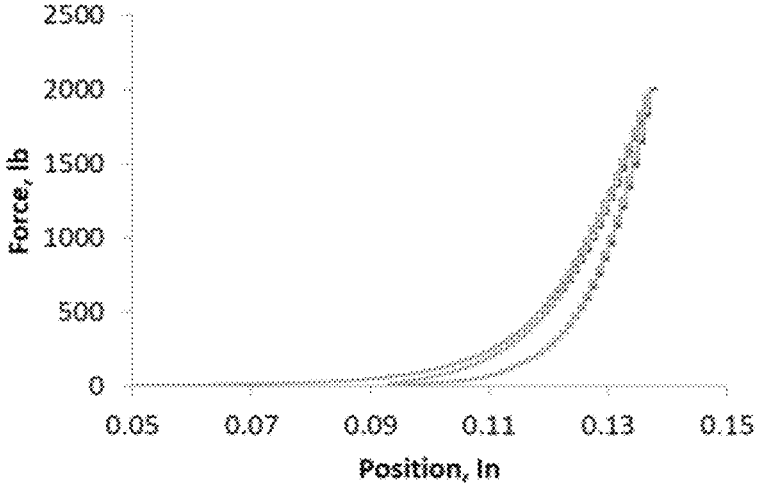
FIG. 12 is a graph illustration of stress-strain curves of wire woven materials for elasticity.
Figure 13:
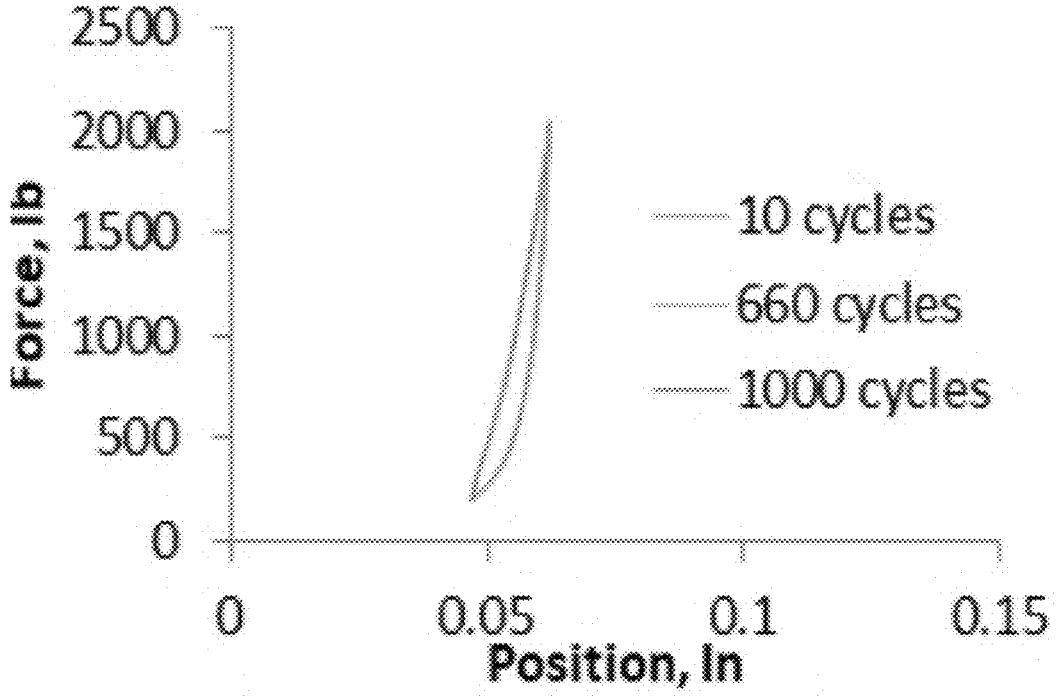
FIG. 13 is a graph illustration of fatigue testing wire woven materials, according to the present invention.

The first force member 60 member is comprised of a first wire woven material 62 with a first elasticity. The first wire woven material is comprised of spring wire 64, as shown in FIGS. 9 and 10. The spring wire is braided and compression molded. The spring wire 64 can have a wire diameter between 0.005-0.05 inches for the braiding and compression molding needed for downhole conditions. The braided and compression molded spring wire 64 of this size can fit in the limited space between the holder 30 and holder housing 17 of the drill bit 15. FIG. 11 shows larger compressive loading in fabrication leads to a higher elastic modulus. Compressive loading can set the first elasticity. For a first force member 60 in the force modulation system 10, the first elasticity should be between 0.02 and 0.13" displacement. Only particular compressive loading can achieve the result, and FIG. 11 shows that increasing force of compressive loading during fabrication for higher elastic modulus does not lead to the first elasticity needed for the present invention. FIG. 12 shows the stress-strain curve of one embodiment of the first wire woven material 62 with a spring wire 64 having a wire diameter of 0.013" and compressive loading of 18 ksi to achieve the first elasticity between 0.02 and 0.13" displacement. The first woven material 62 of the present invention provides the first elasticity to be used in a pre-compressed condition. As shown in FIG. 13, the first wire woven material 62 maintains the first elasticity between 0.02-0.13 inches over 660 cycles of compression. The durability is suitable for downhole conditions, such as higher temperatures and pressure.

FIG. 10 further shows the first woven material 62 being comprised of a spring wire 64 having a corrosion resistant coating 66. The additional protection from chemical degradation in the downhole conditions further increase durability. The corrosion resistant coating 66 is selected from a group consisting of steel, Ni alloy, Co alloy, Ti alloy, and Cu alloy.

The first force member 60 is positioned against the holder 30 so as to exert a first force in a second direction 44 of the holder 30. The second direction 44 is angled offset to the first direction 42, as shown in FIGS. 2-3. FIG. 2 shows the first direction 42 of the holder 30 by the holder retention means 50, and the second direction 44 of the holder 30 by the first force member 60. FIG. 2 shows the second direction 44 as orthogonal to the first direction 42. Relative to the holder cavity 40, the first direction 42 can be vertical, and the second direction 44 can be horizontal. The second direction 44 can also be offset to the first direction 42. The angle of offset can range from 60 to 120 degrees. The first force has at least a vector of force in the second direction 44. At least one vector of force in the second direction is shown generally horizontal and not aligned with the first direction.

Alternatively, the first direction 42 can be a direction of movement of the holder 30 relative to the drill bit 15, and the second direction 44 is another direction of movement of the holder 30 relative to the drill bit 15, including orthogonal to first direction 42. FIGS. 2 and 3 show the drill bit 15 and the dimensions of movement of the holder 30 relative to the drill bit 15. The holder retention force in the first direction 42 maintains position relative to the drill bit in the first direction 42. The first force in the second direction 44 determines the cutting profile of the force modulation system 10. The first force member 60 exerts a first force that is variable so that the cutter 20 avoids damage from excessive force in the second direction 44. Unlike the prior art systems, the second direction 44 of the first force member 60 is not the same as the first direction 42. The second direction 44 is offset angled so that excessive force of a different direction than the first direction 42 can be avoided. FIG. 2 shows the second direction 44 orthogonal to the first direction 42. FIG. 3 shows the second direction 44 offset or even perpendicular from the first direction 42. The angle of offset can range from 60 to 120 degrees. The first force member 60 in the position as shown is now more than just cumulative with the holder retention means 50 to help resist depth of cut force. There is a new relationship between the first force member 60 and the holder retention means 50. There is new functionality of the force modulation system 10 to avoid damage from excessive force from different angles on the cutter 20.

FIGS. 3-8 show alternate embodiments of the force modulation system 10 of the present invention with a second force member 70 positioned against the holder 30 so as to exert a second force in the first direction 42 of the holder 30. In this embodiment, the holder retention means 50 can have the holder retention force greater than the second force with both in the first direction 42. The holder retention means 50 can be set as a breaking point before a critical amount of excessive force disables the holder retention means 50. To protect the snap ring from snapping or the screw from fracturing, the second force member 70 provides the second force in the first direction 42 as a supplement to the holder retention force in the first direction 42. The cutting profile is now variable in the first direction 42, according to the second force member 70. The cutter 20 can avoid the damage of excessive force in the first direction 42 AND in the second direction 44 in the embodiment of FIGS. 3-8. The second force member 70 can be cumulative and cooperative with the holder retention means 50 to resist depth of cut force.

FIG. 3 shows an embodiment with the second force member 70 completely cooperative with the holder retention means 50. The second force member 70 is aligned vertically with the holder retention means 50. The second force member 70 member is comprised of a second wire woven material 72 with a second elasticity. The second wire woven material is comprised of spring wire 74, as shown in FIGS. 9 and 10 as identical to the first force member. The spring wire 74 is also braided and compression molded for downhole conditions. The braided and compression molded spring wire 74 of this size can fit in the limited space between the holder 30 and holder housing 17 of the drill bit 15. The second elasticity is similarly between 0.02 and 0.13" displacement by compressive loading the braided spring wire. As shown in FIG. 13, the second wire woven material 72 also maintains the second elasticity between 0.02-0.13 inches over 660 cycles of compression. The durability is suitable for downhole conditions, such as higher temperatures and pressure.

FIGS. 4-8 show embodiments of the first force member 160 as being made integral with the second force member 170. The first wire woven material 161 is compatible with and bonded to the second wire woven material 171. FIGS. 4-8 show the first wire woven material 161 being identical to the second wire woven material 171. As a unitary body 181, the first force member 160 is made integral with the second force member 171. This unitary body 181 has a first portion 162, a second portion 172, and a hinge portion 180 between the first portion 162 and the second portion 172. The first force member 160 being the first portion 162 and the second force member 170 being the second portion 172 even as the portions 162, 172 are parts of the same unitary body 181 of the same material. The offset angled relationship as orthogonal for the first direction 42 and second direction 44 are also shown in FIGS. 3-8, even with the first force member 160 and the second force member 170 being unitary.

Figure 7:
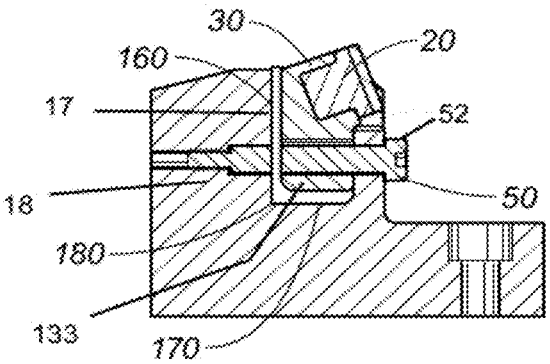
FIG. 7 is a schematic sectional view of an embodiment of an embodiment of the force modulation system, according to FIG. 5.
Figure 8:
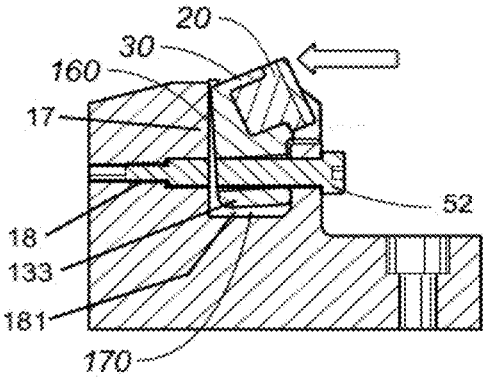
FIG. 8 is another schematic sectional view of an embodiment of an embodiment of the force modulation system, according to FIG. 5.

For the holder 30, the holder sides are longer than the anchor end 34 and the holding end 36 so as to form an elongated holder body 132 having the anchor end 134, the holding end 136 opposite the anchor end 134 and elongated holder sides 138 as the holder sides. This elongated holder body 132 forms an anchor portion 135 between the holder opening 40 and the anchor end 134, the first direction being along the elongated holder sides 138. The first force member 160 being made integral with the second force member 170 is shown for this elongated holder body 132. FIGS. 7-8 show the sequence of exerting force on the cutter 20 with the first force member 160 resisting a force from a rock formation. FIG. 7 maintains the original position, and FIG. 8 shows the first force member 160 resisting the force from the rock formation.

Figure 4:
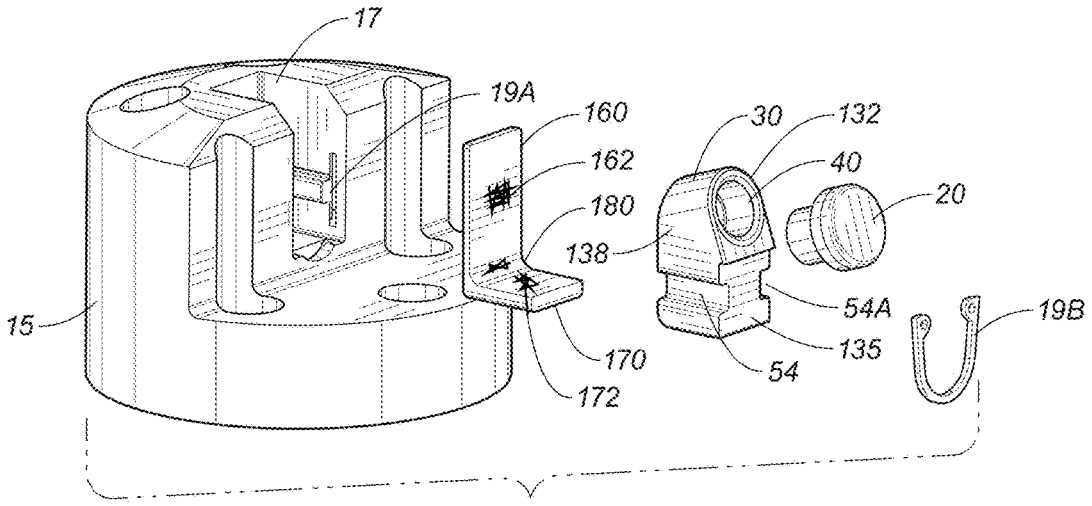
FIG. 4 is an exploded schematic perspective view of an embodiment of the force modulation system according to still another embodiment of the present invention.

For the embodiments of FIG. 4, the holder retention means 50 is comprised of a plurality of slots 54, 54A on the elongated body 132. FIG. 4 shows the exploded view of the slots 54, 54A so as to be friction fit in the drill bit 15. There is a holder housing 17 with a protrusion 19, 19A. The slot 54 is in removable sliding engagement with the protrusion 19 so as to exert the holder retention force in the first direction 42. In some embodiments, there is another slot 54A on another side of the elongated body 132 in removable sliding engagement with another protrusion 19A of the holder housing 17. Embodiments of the protrusions 19, 19A are shown as rails in FIGS. 8-10. There is a locking shoulder engagement between the slots 54, 54A and the protrusions 19, 19A as rails. There is a slot retention member 19B to friction fit between the holder 30 and the holder housing 17.

Figure 5:
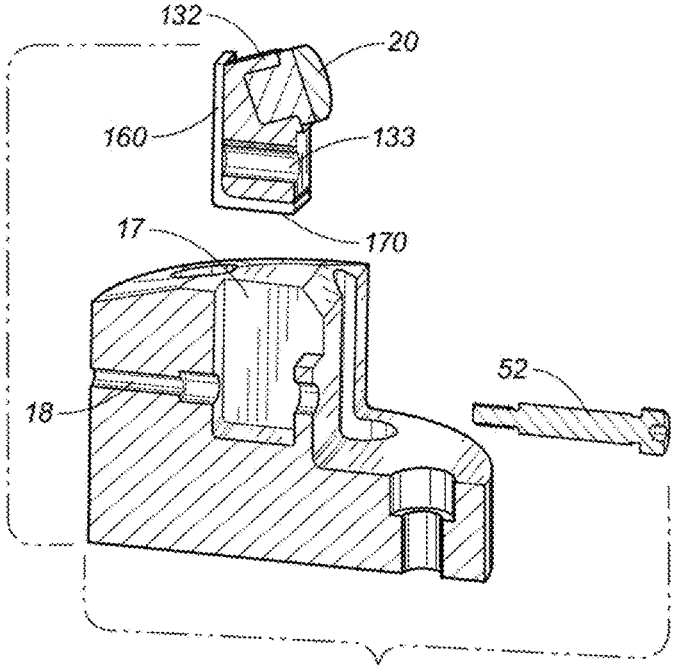
FIG. 5 is a schematic partial sectional and partial perspective view of an embodiment of the force modulation system according to yet another embodiment of the present invention.
Figure 6:
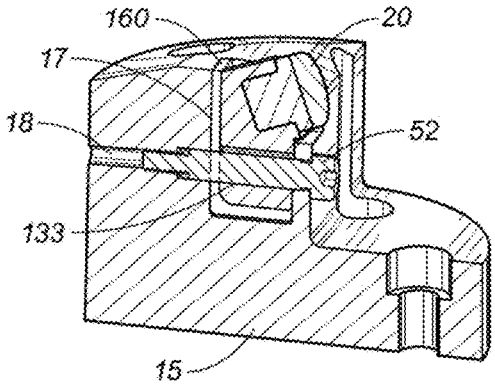
FIG. 6 is a schematic partial sectional and partial perspective view of an embodiment of the force modulation system, according to FIG. 5.

For the embodiments of FIGS. 5-8, the holder retention means the holder retention means 50 is comprised of a screw 52. For the screw 52, there is a holder housing 17 of the drill bit 15 being comprised of a threaded hole 18, and the elongated holder body 132 has a through hole 133. The screw 52 is in removable threaded engagement with the threaded hole 18 through the through hole 133 of elongated holder body 132. The assembled view is shown in FIGS. 6-8 with the screw 52 visible on the drill bit 15. The exploded view of FIG. 5 shows the screw 52 before assembly through the drill bit 15 and the elongated holder body 132. The drill bit 15 can fit the screw 52 around the first force member 160 being made integral with the second force member 170. The first force member 160 being made integral with the second force member 170 may also have a hole for the screw 52 to pass through the first force member 160 being made integral with the second force member 170.

The present invention also includes the method of manufacturing the first woven material 62, 161 and second woven material 72, 171 of the present invention. The method includes braiding wire so as to form braided spring wire and compression molding the braided spring wire so as to form the first wire woven material 62, 161. The method can also include forming the second wire woven material 72, 171, including the embodiments when the first force member 60, 160 and the second force member 70, 170 are made integral as a unitary body. The step of compression molding is comprised of the step of applying a load between 3-30 ksi, and a particular embodiment is applying a load of 18 ksi for the wire having a wire diameter of 0.005 to 0.05 inches. It is an object of the present invention to provide a force modulation system with a variable cutting profile of a drill bit.

The present invention is a force modulation system for a drill bit. The system forms a variable cutting profile as the fixed cutters can have different contact on a rock formation while drilling. The cutting profile changes to avoid excessive force that would damage the fixed cutters. The force modulation system has particular usefulness for fixed cutters on the blade of the bit body or shoulder of the drill bit. These cutters on the blade of the bit body or shoulder of the drill bit typically drill the rock formation at junctions between different types of rock materials. There is a higher risk of excessive force to damage cutters at these joints. The force modulation of the system can avoid this excessive force.

The present invention is a force modulation system with an elastic force member for downhole conditions. The elastic force member is made of a wire woven material that has the durability to withstand downhole temperatures and pressure. The material is braided and compression molded spring wire form into a woven material. The spring wire can also have a coating to protect against corrosion. The wire woven elastic member as a force member fits in the limited space of a drill bit. The wire woven material can be shaped and placed between the holder and drill bit.

The present invention is a multi-directional force modulation system. Instead of being restricted to the one direction of in and out of the drill bit cavity, corresponding only to depth of cut, the system can also move cutters in another direction side to side within the drill bit cavity. The cutting profile is variable in more than one dimension. In some embodiments, the first direction is set by a holder retention member relative to the drill bit, and the second direction is set by the first force member offset from the holder retention member. In other embodiments, there is a second force member that is set in the first direction to back up the holder retention member.

The first direction and the second direction are angled offset from each other. The first and second directions can be orthogonal to each other. The holder retention force can be in the first direction, and the first force can be in the second direction. In alternate embodiments, forces are not completely aligned in a single direction. The first force is not in the first direction or the second direction. At least a vector of the first force must be in the second direction, not all of the first force. For other variable cutting profiles, there is no avoidance of excessive forces from more than one direction. Additionally, the cutter is rotatable so that the cutting surface extending from the holder cavity can affect the resistance to excessive forces. The variable cutting profiles of the prior art only compensate for a particular excessive force to avoid damage, instead of the different excessive forces from different directions. In the prior art systems, the one direction must be selected according to placement of the fixed cutter on the part of the drill bit. The multi-directional force modulation system can now avoid excessive force from more than one direction. The drill bit has an extended working life by avoid more excessive force on cutters than other prior art systems.

The force modulation system can also have an elongated holder body. The elongated holder body has an anchor portion that allows the holder to attach to the drill bit without overlapping with the cutter being attached to the holder. The separation of the connectors between the holder and the drill bit and the connectors between the holder and the cutter maintains the same relationships between the holder retention means in the first direction and the first force member in the second direction. This arrangement is more durable. The wear of the connection between the holder and the drill bit is now separate from any wear of the holder and the cutter. A cutter can be replaced in the holder, if the holder remains in good condition and can still be engaged with the drill bit.

The foregoing disclosure and description of the invention is illustrative and explanatory thereof. Various changes in the details of the illustrated structures, construction and method can be made without departing from the true spirit of the invention.

We claim:

1. A force modulation system for a drill bit, comprising:

a cutter being comprised of a cutter body having a cutting end, and a cutting surface made integral with said cutter body at said cutting end;

a holder being comprised of a holder body having an anchor end, a holding end opposite said anchor end, holder sides between said anchor end and said holding end, and a holder cavity at said holding end, said cutter body being in removable slide fit engagement with said holder cavity;

a holder retention means positioned on at least one holder side so as to exert a holder retention force in a first direction of said holder;

a first force member positioned against said holder so as to exert a first force in a second direction of said holder, said second direction being angled offset to said first direction, wherein said first force member is comprised of a first wire woven material with a first elasticity; and a second force member positioned against said holder so as to exert a second force in said first direction of said holder, wherein said second force member is comprised of a second wire woven material with a second elasticity, wherein first force member is made integral with said second force member, said first wire woven material being compatible with and bonded to said second wire woven material, wherein said first wire woven material is identical to said second wire woven material, said first wire woven material and said second wire woven material forming a unitary body, and wherein said unitary body is comprised of a first portion, a second portion, and a hinge portion between said first portion and said second portion, said first force member being comprised of said first portion, said second force member being comprised of said second portion.

2. The force modulation system, according to claim 1, said cutter being removably engaged with said holder, said cutting surface being extended from said holder so as to cut a rock formation.

3. The force modulation system, according to claim 1, wherein said first wire woven material is comprised of spring wire, said spring wire being braided and compression molded.

4. The force modulation system, according to claim 3, wherein said spring wire has a wire diameter between 0.005-0.05 inches.

5. The force modulation system, according to claim 3, wherein said first wire woven material is further comprised of a corrosion resistant coating on said spring wire.

6. The force modulation system, according to claim 5, wherein said corrosion resistant coating is selected from a group consisting of steel, Ni alloy, Co alloy, Ti alloy, and Cu alloy.

7. A method, comprising the steps of:

braiding wire so as to form braided wire;

forming said braided wire into said spring wire of claim 3;

compression molding said spring wire so as to form said first wire woven material.

8. The method, according to claim 7, wherein the step of compression molding is comprised of the step of applying a load between 3-30 ksi.

9. The method, according to claim 8, wherein said load is 18 ksi, said spring wire has a wire diameter between 0.005-0.05 inches.

10. The force modulation system, according to claim 1, wherein said first elasticity is between 0.09-0.13 inches over 200 cycles of compression.

11. The force modulation system, according to claim 1, wherein said holder sides are longer than said anchor end and said holding end so as to form an elongated holder body having said anchor end, said holding end opposite said anchor end and elongated holder sides as said holding sides.

12. The force modulation system, according to claim 11, wherein said elongated holder body is comprised of an anchor portion between said holding cavity and said anchor end, said first direction being along said elongated holder sides.

13. The force modulation system, according to a claim 1, wherein said second force member is positioned against said anchor end of said holder so as to exert said second force in said first direction of said holder.

14. A force modulation system, comprising:

a cutter being comprised of a cutter body having a cutting end, and a cutting surface made integral with said cutter body at said cutting end;

a holder being comprised of a holder body having an anchor end, a holding end opposite said anchor end, holder sides between said anchor end and said holding end, and a holder cavity at said holding end, said cutter body being in removable slide fit engagement with said holder cavity;

a holder retention means positioned on at least one holder side so as to exert a holder retention force in a first direction of said holder;

a first force member positioned against said holder so as to exert a first force in a second direction of said holder, said second direction being angled offset to said first direction, wherein said first force member is comprised of a first wire woven material with a first elasticity; and a second force member positioned against said holder so as to exert a second force in said first direction of said holder, wherein said second force member is comprised of a second wire woven material with a second elasticity, wherein first force member is made integral with said second force member, said first wire woven material being compatible with and bonded to said second wire woven material, wherein said first wire woven material is identical to said second wire woven material, said first wire woven material and said second wire woven material forming a unitary body, wherein said unitary body is comprised of a first portion, a second portion, and a hinge portion between said first portion and said second portion, said first force member being comprised of said first portion, said second force member being comprised of said second portion, wherein said second force member is positioned against said anchor end of said holder so as to exert said second force in said first direction of said holder, and wherein said holder retention means is comprised of:

a holder housing being comprised of a protrusion, and a slot on said elongated holder body being in removable sliding engagement with said protrusion.

15. The force modulation system, according to claim 14, wherein said holder housing is comprised of another protrusion, and wherein said holder retention means is comprised of another slot on said elongated holder body being in removable sliding engagement with said another protrusion.

16. A force modulation system, comprising:

a cutter being comprised of a cutter body having a cutting end, and a cutting surface made integral with said cutter body at said cutting end;

a holder being comprised of a holder body having an anchor end, a holding end opposite said anchor end, holder sides between said anchor end and said holding end, and a holder cavity at said holding end, said cutter body being in removable slide fit engagement with said holder cavity;

a holder retention means positioned on at least one holder side so as to exert a holder retention force in a first direction of said holder;

a first force member positioned against said holder so as to exert a first force in a second direction of said holder, said second direction being angled offset to said first direction, wherein said first force member is comprised of a first wire woven material with a first elasticity; and a second force member positioned against said holder so as to exert a second force in said first direction of said holder, wherein said second force member is comprised of a second wire woven material with a second elasticity, wherein first force member is made integral with said second force member, said first wire woven material being compatible with and bonded to said second wire woven material, wherein said first wire woven material is identical to said second wire woven material, said first wire woven material and said second wire woven material forming a unitary body, wherein said unitary body is comprised of a first portion, a second portion, and a hinge portion between said first portion and said second portion, said first force member being comprised of said first portion, said second force member being comprised of said second portion, wherein said second force member is positioned against said anchor end of said holder so as to exert said second force in said first direction of said holder, and wherein said holder retention means is comprised of:

a holder housing being comprised of a threaded hole, a through hole in said elongated holder body, and a screw being in removable threaded engagement with said threaded hole through said through hole.

* * * * *